US005762054A

United States Patent [19]

Schumacher et al.

[11] Patent Number: 5,762,054

[45] Date of Patent: Jun. 9, 1998

[54] EGO BASED ADAPTIVE TRANSIENT FUEL COMPENSATION FOR A SPARK IGNITED ENGINE

[75] Inventors: Darren A. Schumacher, Ypsilanti; Kevin J. Bush, Northville, both of Mich.

[73] Assignee: Motorola Inc., Schaumburg, Ill.

[21] Appl. No.: 713,577

[22] Filed: Sep. 13, 1996

[51] Int. Cl.[6] ..... F02D 41/00

[52] U.S. Cl. ..... 123/674

[58] Field of Search ..... 123/674, 492, 123/480, 424; 60/276; 364/431.06

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,481,928 | 11/1984 | Takimoto et al. | 123/492 |
| 4,939,658 | 7/1990 | Sekozawa et al. | 364/431.06 |
| 5,448,978 | 9/1995 | Hasegawa et al. | 123/480 |
| 5,511,526 | 4/1996 | Hamburg et al. | 123/424 |
| 5,529,047 | 6/1996 | Aota et al. | 123/674 |
| 5,544,638 | 8/1996 | Yuda | 123/674 |
| 5,546,917 | 8/1996 | Osanai et al. | 123/674 |
| 5,566,662 | 10/1996 | Messih | 123/674 |
| 5,615,550 | 4/1997 | Ogawa et al. | 60/276 |

FOREIGN PATENT DOCUMENTS 0 152 109 A2 8/1985 European Pat. Off. .

OTHER PUBLICATIONS

"Real Time Engine Control Using STR in Feedback System" by Maki, Akazaki, Hasegawa, Komoriya, Nishimura and Hirota, 1995.

"Adaptive Air–Fuel Ratio Control of a Spark–Ignited Engine" by Aault, Jones, Powell and Franklin.

"An Adaptive Fuel Injection Control with Internal Model in Automotive Engines" by Inagaki, Ohata and Inoue.

"Adaptive Compensation of Fuel Dynamics in an SI Engine Using a Switching EGO Sensor" by P.E. Moraal, Ford Research Laboratories.

*Primary Examiner*—Raymond A. Nelli

*Attorney, Agent, or Firm*—Nicholas C. Hopman

[57] ABSTRACT

A method and system for adaptive transient fuel compensation in an engine (300) estimates fuel puddle dynamics for a cylinder in an engine by determining parameters of a wall-wetting model on every engine cycle by measuring a temporal delay (407) between when an identification fuel charge is injected (405) and when a binary-type exhaust gas oxygen sensor (213) switches state. Fuel delivery to the cylinder is adjusted (417) dependent on the estimated fuel puddle dynamics which are a function of the measured temporal delay (407).

18 Claims, 4 Drawing Sheets

$m_f$: FUEL FILM MASS
$m_{dep}$: FUEL MASS DEPOSITED IN FILM
$m_v$: FUEL VAPOR FROM FILM
$m_i$: FUEL MASS INJECTED
$m_c$: FUEL MASS ENTERING CYLINDER
c: FUEL FRACTION PARAMETER
$b_v$: FUEL FILM VAPORIZATION PARAMETER
k: ENGINE CYCLE INDEX $$m_f(k) = m_f(k-1) + m_{dep}(k) - m_v(k)$$
$$m_{dep}(k) = cm_i(k)$$
$$m_v(k+1) = b_v m_f(k)$$
$$m_c(k) = (1-c)m_i(k) + m_v(k)$$

EGO BASED ADAPTIVE TRANSIENT FUEL COMPENSATION FOR A SPARK IGNITED ENGINE

FIELD OF INVENTION

This invention is generally directed to the field of engine control, and specifically for control of air/fuel ratio in a spark ignited engine by adaptively adjusting fuel delivery dependent on a measurement of certain fuel delivery system dynamic behavior.

BACKGROUND OF THE INVENTION

In order to reduce automotive emissions in an internal combustion engine, precise control of the air/fuel ratio is necessary. This is complicated by the deposit of fuel on the walls of the intake manifold and on the intake valves (wall-wetting). Wall-wetting dynamics has been characterized by two parameters corresponding to a fraction of the injected fuel which is deposited on the walls of the intake manifold, and a fraction of fuel evaporating off of the intake manifold walls. These parameters vary with engine operating condition, engine age, and fuel volatility, making it difficult to compensate for wall-wetting with a non-adaptive controller. Furthermore, during nontrivial transients, the wall-wetting parameters may vary rapidly with rapidly varying operating conditions, resulting in increased emissions because of deviations in air/fuel ratio away from stoichiometry. Therefore, it is desirable to identify these wall-wetting parameters on line and on a cycle-by-cycle basis, which permits a self-tuning control system to use this information to properly compensate the wall-wetting dynamics. State of the art adaptive controllers accomplish this task by utilizing a UEGO (Universal Exhaust Gas Oxygen) sensor, which provides an accurate estimate of air/fuel ratio. The UEGO sensor provides a signal indicative of a magnitude of oxygen in the exhaust gas stream, and has a principally linear response to varying concentration of oxygen. The UEGO sensor, however, is significantly more complex and expensive than the current industry standard EGO (Exhaust Gas Oxygen) sensor. The EGO sensor is a binary-type sensor that only provides information as to whether or not the exhaust is rich or lean, and not the magnitude of the control error as in the case of the UEGO sensor. So, an EGO sensor can not be reasonably used in a transient fuel compensation control system designed to accommodate a UEGO sensor.

Current EGO based adaptive fuel control schemes are computationally intensive and do not achieve adaptation over time periods shorter than several FTP (Federal Test Procedure) test cycles. Furthermore, current EGO based adaptive fuel control schemes do not adapt to varying wall-wetting without waiting for an emissions increasing transient error to occur.

Therefore, what is needed is an adaptive wall-wetting compensation scheme using an EGO sensor to compensate fuel that is both computationally simple and can operate on an engine cycle-by-cycle basis. An EGO adaptive scheme should also adapt to varying wall-wetting dynamics without waiting for large excursions in the normalized fuel/air ratio before adjusting fuel delivery.

DETAILED DESCRIPTION OF A PREFERRED EMBODIMENT

A method and system for adaptive transient fuel compensation in a cylinder of an engine determines compensator gains by measuring a temporal delay between when an identification fuel charge is injected and when a binary-type exhaust gas oxygen sensor switches state. Base fuel delivery to the cylinder is adjusted dependent on the compensator gains which are a function of the measured temporal delay, and hence the wall-wetting dynamics.

By implementing the essential structure just described, a more accurate fuel compensation approach for a spark ignition engine that accounts for time varying fuel injection dynamic behavior due to causes such as engine operating conditions, engine age, and fuel composition without requiring excessive computational resources can be constructed. The structural approach detailed below determines appropriate gains for a wall-wetting compensator, stores these gains as a function of engine operating conditions (if required), and then uses these gains to accurately compensate for the wall-wetting dynamics by controlling delivery of fuel to the engine. The goals of this novel compensation approach are to reduce the normalized air/fuel ratio (lambda) deviations away from stoichiometry (lambda equals one) in the exhaust stream which occur during engine transients at both warm and cold engine operating conditions, using a computationally efficient approach that is easily implemented, while achieving fast convergence by exploiting a model structure Before detailing specific structures for constructing a preferred embodiment a little theoretical background would be useful to fully appreciate the advantages and alternative structures.

Model Description

Figure 1:
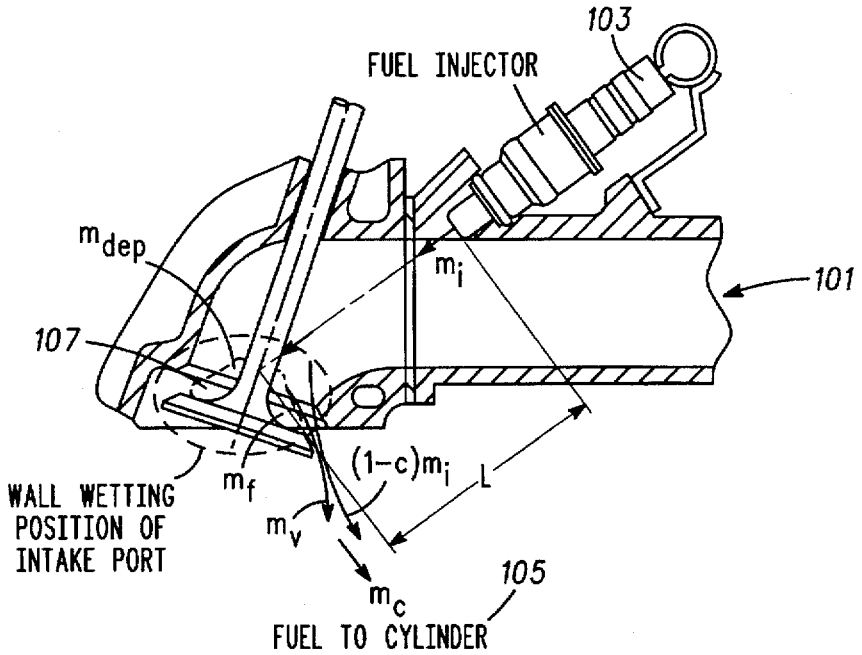
FIG. 1 is a schematic diagram of a fuel film (wall-wetting) model.

FIG. 1 is a schematic diagram of a fuel film (wall-wetting) model useful for representing an amount of fuel deposited, and a subsequent amount evaporated per engine cycle, on walls of an intake manifold and on intake valves of the engine. The illustrated model is characterized by two parameters, C and $b_v$. A parameter C denotes a fraction of fuel from a given fuel injection event that adheres to (puddles on) the manifold walls, intake valves, or other structure preventing the full fuel charge from reaching the cylinder's combustion chamber. Note that if C is equal to one, none of the fuel injected feeds through directly to the fuel charge in that cylinder for that engine cycle. A second parameter $b_v$, denotes a mass fraction of the puddle that evaporates during a given engine cycle. The illustrated model has an advantage of being based in the crankshaft angle domain, which means that a sampling rate does not appear in the system dynamics.

Adaptive Feedforward Control Strategy

An essential approach of a control strategy employed here is adaptive feedforward control. By determining the appropriate compensator gains necessary to accurately compensate for the effects of wall-wetting on-line, an amount of fuel injected is modified so as to compensate for the effects of wall-wetting on the combustion fuel charge, making it possible to maintain a stoichiometric air/fuel ratio in the cylinder for combustion even under transient engine operating conditions, unaffected by engine aging, fuel composition, and engine temperature. The identified gains can then be used to match the time varying engine dynamic behavior.

The wall-wetting compensation implementation taught here uses a feedforward compensation approach. The amount of desired fuel to match an estimated air charge is input to the compensation method to calculate an amount of fuel to inject to a cylinder in an immediate, proactive control action. Preferably, feedforward control is used for transient compensation, because the transport and sensing delays of the control system limit the bandwidth of the error-driven feedback loop, making adaptive feedback compensation ineffective for fast transient changes in charge air mass.

The preferred approach determines the appropriate wall-wetting compensator gains during periods of steady-state engine operation, including during cold run conditions. Identification of the appropriate wall-wetting compensator gains is based only on the fuel injected, an air charge estimate, and an EGO (Exhaust Gas Oxygen) sensor reading.

The appropriate wall-wetting compensator gains are determined during steady-state engine operation by injecting a fuel or air identification signal of a known behavior into one or more cylinders of an engine. Note that an air identification signal could be introduced rather than a fuel identification signal but with today's engines this is not really practical because air intake is not well controlled. The preferred embodiment of this invention utilizes identification signals with step and impulse characteristics to determine the wall-wetting compensator gains. At a steady state engine operating condition, the normalized fuel/air ratio is biased to a constant value (for example 0.95). The fuel, or alternatively air flow injected is then temporarily biased to another constant value on another side of stoichiometry (for example 1.05). The temporal delay between the temporary injection of the identification signal and when the EGO switches state is then measured (typically in engine cycles). If required and possible, another identification signal is injected having a different structure than the previously injected identification signal, and the corresponding temporal delay is measured (typically in number of engine cycles).

For a given identification signal and a resulting measured temporal delay, the subset of possible wall-wetting dynamics which could have resulted in the measured temporal delay is a subset of the total parameter space (i.e. $c_{1min} \leqq c \leqq c_{1max}$, $b_{v1min} \leqq b_v \leqq b_{v1max}$, and $c_{2min} \leqq c \leqq c_{2max}$, $b_{v2min} \leqq b_v \leqq b_{v2max}$). The union of these sets, accomplished by a priori determining what values of the wall-wetting parameters result in the possible values of the first and second temporal delays, then defines the smallest possible region in parameter space in which the wall-wetting dynamics must reside. A set of corresponding compensator gains is a priori determined off-line which robustly compensate for the possible set of wall-wetting dynamics corresponding to the measured temporal delays. In the preferred embodiment of this invention, the temporal delays are measured in engine cycles (integer values). Therefore, the number of possible combinations of temporal delays for various identification signals is finite and relatively small, and a priori gains can be determined off-line for each possible set of temporal delays. This results in the ability to adjust the wall-wetting compensator gains by using the measurements of the temporal delays directly, without explicitly identifying the corresponding wall-wetting parameters. For a given set of temporal delays, there is a corresponding set of gains, which are then used to robustly compensate for the effects of wall-wetting. The appropriate gains can then be stored as a function of engine operating condition in order to allow for cycle-by-cycle adjustment of the fuel delivery in order to compensate for the effects of wall-wetting.

Figure 2:
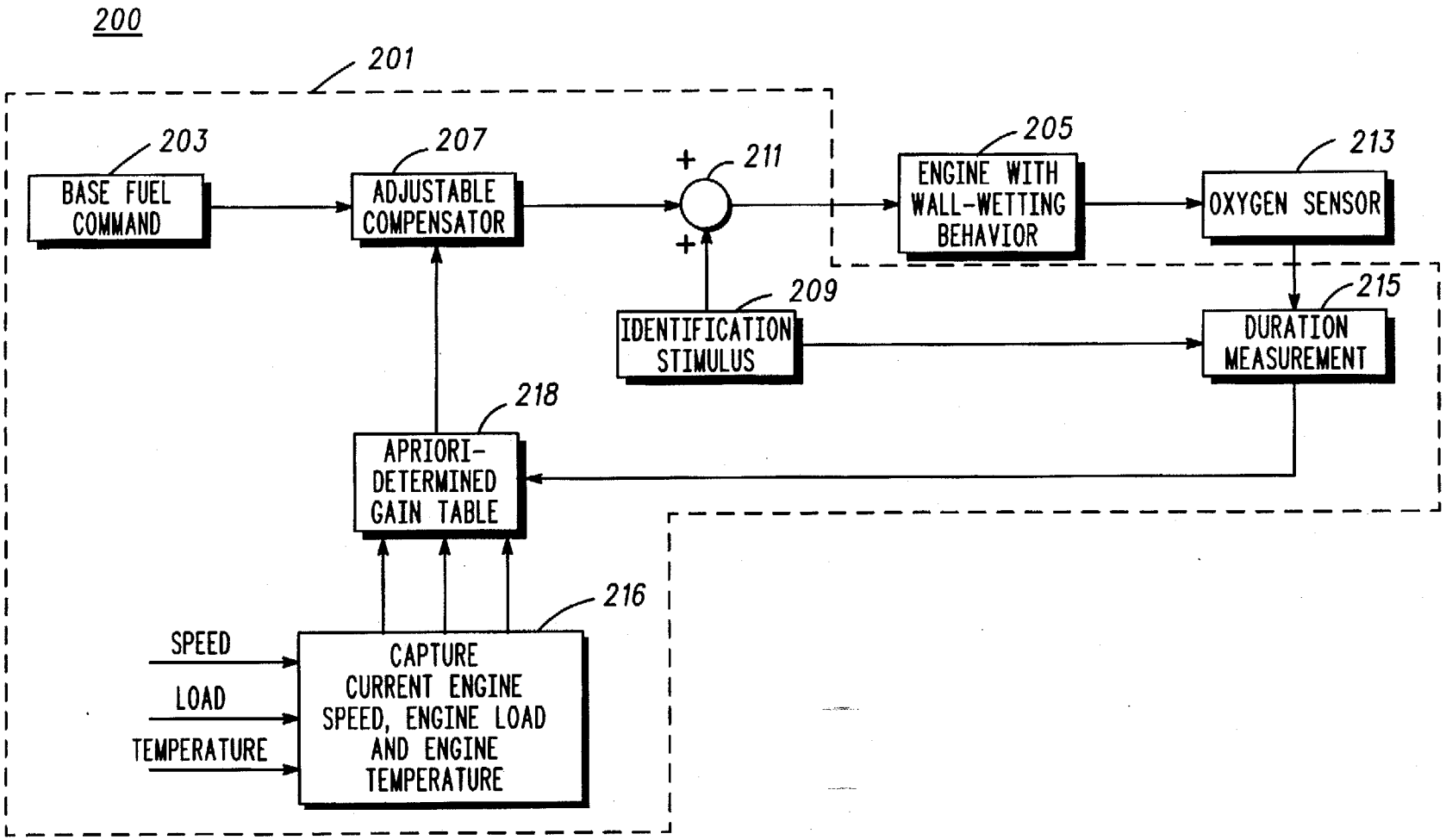
FIG. 2 is a schematic diagram of an adaptive controller in accordance with a preferred embodiment of the invention.

FIG. 2 is a schematic diagram of an adaptive control system 210 in accordance with a preferred embodiment of the invention. A base fuel command 203 is generated by the control system 201 based on operator demand and engine operating conditions. The base fuel command 203 is delivered to an engine 205 via an adjustable feedforward type compensator 207. While the engine 205 is running, the adjustable compensator 207 has gain terms that are set preferably dependent on an a priori-determined model (see FIG. 1). The resulting gains are then dynamically updated to account for engine wear and fuel composition changes by measurement of one or more temporal delays 215 between when an identification fuel charge, or charges, are injected into the engine 205 and when a binary-type exhaust gas oxygen sensor 213 switches state. Preferably, the specific gain terms are stored in a lookup table that is constructed during a calibration phase for an engine, or engine family, prior to end-user deployment. In the calibration phase the engine is controlled to map-out an a priori-determined model using a calibration technique commonly known to engine designers. The calibration technique stimulates the engine to operate over a wide range of engine speeds, engine loads, and engine operating temperatures, and from this procedure the designer can select compensator gains to optimally control the engine's conversion of fuel into energy while keeping exhausted emissions within legislated boundaries.

Since engines age, and fuel composition changes, the a priori-determined gain table can become inadequate to optimally control the engine. Aging and fuel composition changes are substantially negated by updating, or modifying the a priori-determined gain table based on executing active tests on the engine as it runs in the end-user's vehicle. To this end, the a priori-determined gain table is actively recalibrated while the engine is operating in a production vehicle. A key feature of the inventive structure is to enable the determination of changes to the wall-wetting behavior described earlier, on a real-time, engine cycle-by-cycle basis. Once dynamically determined, the a priori-determined gain table is updated. In operation, the adjustable compensator 207 gain terms are set indexed by measured engine speed, engine load, and/or engine temperature which are captured in block 216. Note that is may not be necessary for all metrics (speed, load, and temperature) to be used for all engine applications.

When the engine 205 is operating in a steady-state condition, for example when engine speed and engine load are constant, the a priori-determined gain table is updated to account for engine wear and fuel composition changes During the gain update process the base fuel command 203 is fed into the adjustable compensator 207, and an identification fuel charge, or stimulus 209 is added using a summation operation 211. The output of the summation block 211 represents the fuel charge actually sent to the engine 205. An oxygen sensor 213 is coupled to the exhaust system of the engine 205. Before the identification fuel charge 209 is injected into the engine, the oxygen sensor 213 is in a known and stable state, here lean. The injection of a fuel charge, based on the combined base and identification charge, will cause the exhaust gas to become rich when the combined fuel charge is combusted and exhausted.

A temporal delay, or duration, is measured from the time the fuel charge is sent until the oxygen sensor 213 changes state. Block 215 measures the described duration. The duration can be measured in terms of absolute time duration, in terms of accumulated engine cycles, in terms of accumulated engine degrees, or any other metric representative of a duration, or temporal delay, between the injected fuel charge and the switch in the EGO sensor state. The duration measured in block 215 is used to update the a priori gain table 218. With the essential system block diagram described a system hardware block diagram will be introduced prior to description of the preferred method.

Figure 3:
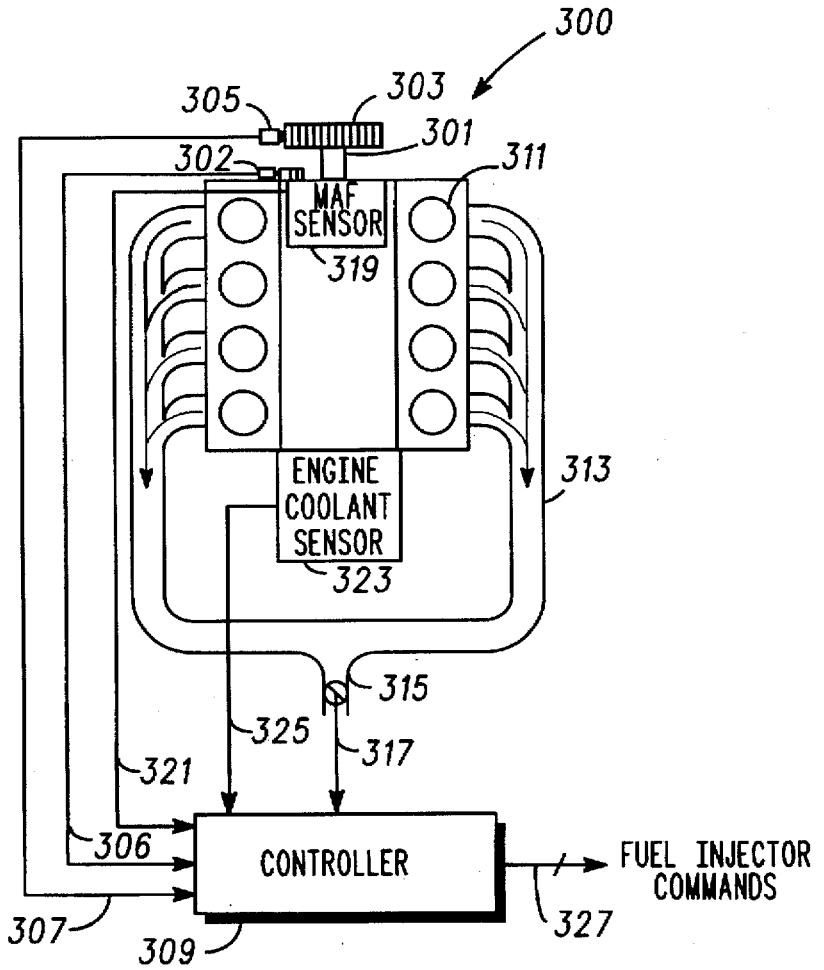
FIG. 3 is a hardware block diagram in accordance with the preferred embodiment of the invention.

FIG. 3 is a hardware block diagram for executing the preferred method steps. The system includes an engine 300 coupled to a crankshaft 301, coupled to a flywheel 303, which provides engine incremental position information 307 to a controller 309, via an encoder 305. Another encoder 302 is mounted in a position to sense camshaft rotation. The camshaft-positioned encoder 302 provides absolute engine position information 306 to the controller 309. Engine absolute position for each cylinder of the engine 300 can be derived in the controller 309 from the information 307 and 306, and is used by the controller 309 for synchronization of the preferred method. The controller is preferably constructed comprising a Motorola MC68332 microcontroller. The Motorola MC68332 microcontroller is programmed to execute the preferred method steps described later in the attached flow charts. Many other implementations are possible without departing from the essential teaching of this embodiment. For instance another microcontroller could be used. Additionally, a dedicated hardware circuit based control system, controlled in accordance with the teachings of this treatise, could be used for estimating fuel puddle dynamics, and a compensator could be used for adjusting fuel delivery.

Returning to FIG. 3, the engine 300 includes a cylinder 311, which through an exhaust manifold 313, drives a binary type oxygen sensor 315. Here, the sensor is an EGO or HEGO (Heated Exhaust Gas Oxygen) type sensor. The EGO sensor 315 is positioned downstream from an exhaust port of the cylinder 311 and measures a rich/lean characteristic from each of the cylinders of the engine 300. The EGO sensor 315 provides a signal 317, indicative of the measured rich/lean characteristic to the controller 309.

An air mass flow rate (MAF) sensor 319 is coupled to an intake manifold of the engine 300. The air mass flow rate sensor 319 provides an output signal 321, indicative of air massflow rate into the engine's intake manifold, to the controller 309. The measured air massflow rate information is used to determine an air charge into the engine as well as a measure of load on the engine. Note that as alternative to employing a MAF sensor, a pressure measurement approach to determining intake airmass charge could be implemented. This type of approach would use an intake air charge sensor—such as an absolute pressure sensor to measure intake manifold pressure, and an engine speed sensor for determining engine speed. An intake massflow rate or other air charge factor can then be calculated dependent on the determined engine speed and the intake manifold pressure. Note that the incremental position information 307 provided by the encoder 305 can be used as a speed signal indicative of rotational speed of the engine 300.

An engine coolant sensor 323 is thermally coupled to the engine 300, and outputs a signal 325 indicative of the engine's operating temperature.

The controller 309 has a bank of output signals 323 which are individually fed to fuel injectors associated with each cylinder of the engine 300.

As described earlier, the EGO sensor signal 317, the intake manifold mass air-flow signal 321, and a stored value of the injected fuel charge commanded by the controller (internal to the controller 309), are used to implement the preferred method.

Figure 4:
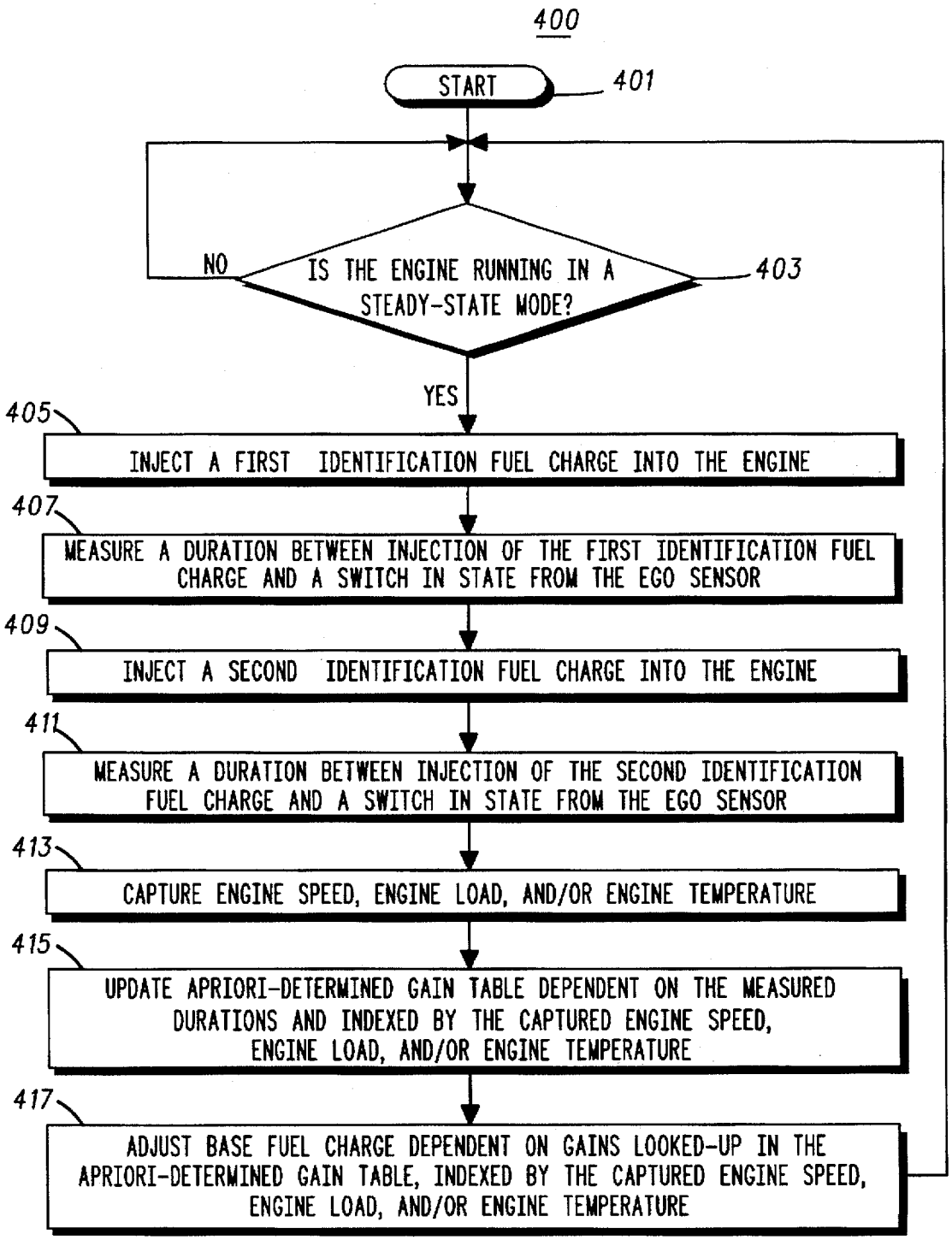
FIG. 4 is a flow chart introducing a method in accordance with the preferred embodiment of the invention.

Next, a simple recalibration method will be described with the aid of FIG. 4. FIG. 4 is a flow chart introducing a method in accordance with the preferred embodiment of the invention. Routine 400 is executed in order to recalibrate, or update, the a priori-determined gain table described earlier. Routine 400 is encoded into the 68332 microcontroller described in block 309 of FIG. 3. The routine 400 commences at a start step 401. Next, in step 403 the routine 400 determines whether or not the engine is running in a steady-state mode. If the engine is running is a steady-state mode, then step 405 is executed. In step 405 a first identification fuel charge, having a first duration, is injected into the engine. Note that the first identification fuel charge is combined with a base fuel charge to form a combined fuel charge prior to injection. Preferably, the first identification fuel charge has an impulse behavior. Essentially, an impulse behavior is defined as an event that has a duration of less than or equal to two complete engine cycles, or 1,440 engine degrees.

Next, in step 407 a duration is measured between the time of injection of the first identification fuel charge and when the EGO sensor switches state.

Then, in step 409 a second identification fuel charge, having a second duration—preferably longer than the first duration, is injected into the engine. Note that the second identification fuel charge is combined with the base fuel charge to form another combined fuel charge prior to injection. Preferably, the second identification fuel charge has a step behavior. A step behavior can be characterized as an injection event that has a duration of two or more engine cycles, in other words equal to or greater than 1,440 engine degrees.

Next, in step 411 a second duration between the injection of the second identification fuel charge and another switch and state from the EGO sensor is measured. Note that although two identification fuel charges and subsequent durations are measured here, in some cases one charge and measurement can be adequate in some applications. Furthermore, more than two charges and subsequent durations can be useful in some applications.

Then, in step 413 the engine's speed, load, and temperature are captured. In step 415 the a priori-determined gain table is updated dependent on the measured temporal delays (first and second durations) and indexed by the captured engine speed, engine load, and/or engine temperature.

Then, in step 417, the base fuel charge is adjusted dependent on gains looked-up in the a priori-determined gain table indexed by the captured engine speed, engine load, and/or engine temperature.

This process can be clarified with the following example. Table 1 shows the delay in engine cycles from injection of the identification signal having an impulse behavior and the resulting switch in the EGO sensor for a particular engine, engine operating condition, and sensor. Note that a value of zero indicates that the impulse never causes the EGO sensor to switch state. For a particular value of this first temporal delay, for example 6 engine cycles, the value of the wall-wetting parameter C denoting a fraction of fuel from a given fuel injection event that adheres to (puddles on) the manifold walls, intake valves, or other structure can only have a value between 0.7 and one. For a value of a first temporal delay of 6 engine cycles, a second parameter $b_v$, denoting a mass fraction of the puddle that evaporates during a given engine cycle, can have a value between 0.2 and 0.7.

TABLE 1

| | | | | | | | | |
|---|---|---|---|---|---|---|---|---|
| 5 | 5 | 5 | 5 | 5 | 5 | 5 | 0.1 | |
| 5 | 5 | 5 | 5 | 5 | 5 | 5 | 0.2 | |
| 5 | 5 | 5 | 5 | 5 | 5 | 5 | 0.3 | |
| 5 | 5 | 5 | 5 | 5 | 5 | 5 | 0.4 | |
| 5 | 5 | 5 | 5 | 5 | 5 | 5 | 0.5 | c |
| 5 | 5 | 5 | 5 | 5 | 5 | 5 | 0.6 | |
| 0 | 5 | 6 | 6 | 6 | 6 | 6 | 0.7 | |
| 0 | 5 | 6 | 6 | 6 | 6 | 6 | 0.8 | |
| 0 | 6 | 6 | 6 | 6 | 6 | 6 | 0.9 | |
| 0 | 6 | 7 | 7 | 6 | 6 | 6 | 1 | |
| 0.1 | 0.2 | 0.3 | 0.4 | 0.5 | 0.6 | 0.7 | | |
| | | | $b_v$ | | | | | |

Note that for slow puddle dynamics (C approximately one and $b_v$ low), the identification signal having an impulse behavior may not even appear at the EGO sensor.

Table 2 shows the delay in engine cycles from injection of the identification signal having a step behavior and the resulting switch in the EGO sensor for the same engine, operating condition, and sensor as just described. For a particular value of the second temporal delay, for example 4 engine cycles, the value of a wall-wetting parameter C denoting a fraction of fuel from a given fuel injection event that adheres to (puddles on) the manifold walls, intake valves, or other structure can only have a value between 0.6 and one. For a value of a second temporal delay of 4 engine cycles, a second parameter $b_v$, denoting a mass fraction of the puddle that evaporates during a given engine cycle, can have a value between 0.1 and 0.5.

TABLE 2

| | | | | | | | | |
|---|---|---|---|---|---|---|---|---|
| 2 | 2 | 2 | 2 | 2 | 2 | 2 | 0.1 | |
| 2 | 2 | 2 | 2 | 2 | 2 | 2 | 0.2 | |
| 2 | 2 | 2 | 2 | 2 | 2 | 2 | 0.3 | |
| 2 | 2 | 2 | 2 | 2 | 2 | 2 | 0.4 | |
| 3 | 3 | 3 | 3 | 3 | 3 | 3 | 0.5 | c |
| 4 | 3 | 3 | 3 | 3 | 3 | 3 | 0.6 | |
| 6 | 4 | 3 | 3 | 3 | 3 | 3 | 0.7 | |
| 7 | 5 | 4 | 3 | 3 | 3 | 3 | 0.8 | |
| 8 | 5 | 4 | 4 | 3 | 3 | 3 | 0.9 | |
| 9 | 6 | 4 | 4 | 4 | 3 | 3 | 1 | |
| 0.1 | 0.2 | 0.3 | 0.4 | 0.5 | 0.6 | 0.7 | | |
| | | | $b_v$ | | | | | |

Note that for slow puddle dynamics (C approximately one and $b_v$ low), the identification signal having a step behavior does not appear at the EGO sensor until much later than it would for fast puddle dynamics (C low and $b_v$ high).

These first and second temporal delays can then be written as a single number, in this example 64. The fusion of Table 1 and Table 2 is shown in Table 3. For a value of the first and second temporal delays of 6 and 4, respectively, (or 64), the value of a wall-wetting parameter C denoting a fraction of fuel from a given fuel injection event that adheres to (puddles on) the manifold walls, intake valves, or other structure can only have a value between 0.8 and one For a value of the first and second temporal delays of 6 and 4, respectively, (or 64), a second parameter $b_v$, denoting a mass fraction of the puddle that evaporates during a given engine cycle, can have a value between 0.3 and 0.5.

TABLE 3

| | | | | | | | | |
|---|---|---|---|---|---|---|---|---|
| 52 | 52 | 52 | 52 | 52 | 52 | 52 | 0.1 | |
| 52 | 52 | 52 | 52 | 52 | 52 | 52 | 0.2 | |
| 52 | 52 | 52 | 52 | 52 | 52 | 52 | 0.3 | |
| 52 | 52 | 52 | 52 | 52 | 52 | 52 | 0.4 | |
| 53 | 53 | 53 | 53 | 53 | 53 | 53 | 0.5 | c |
| 54 | 53 | 53 | 63 | 63 | 63 | 63 | 0.6 | |
| 06 | 54 | 63 | 63 | 63 | 63 | 63 | 0.7 | |
| 07 | 55 | 64 | 63 | 63 | 63 | 63 | 0.8 | |
| 08 | 65 | 64 | 64 | 63 | 63 | 63 | 0.9 | |
| 09 | 66 | 74 | 74 | 64 | 63 | 63 | 1 | |
| 0.1 | 0.2 | 0.3 | 0.4 | 0.5 | 0.6 | 0.7 | | |
| | | | $b_v$ | | | | | |

Therefore, for a value of the first and second temporal delays of 6 and 4, respectively, (or 64), the gains of the compensator are a priori determined off-line to provide robust performance for values of the wall-wetting parameters of $0.8 \leqq c \leqq 1.0$ and $0.3 \leqq b_v \leqq 0.5$. Note that for this example, Table 3 contains only twelve different numbers, so only twelve sets of wall-wetting compensator gains need to be determined a priori. Once the temporal delays are measured, they are stored in a table indexed as a function of engine operating condition so that the recalibrated gains can be used to extend the benefit of the adaptation to an engine cycle-by-cycle basis. For example, the aforementioned value of 64 can correspond to an engine operating condition of 1,500 RPM, an engine load measurement of 90 kPa from the pressure sensor, and an engine temperature of 90 degrees Celsius. Note that is may not be necessary for all metrics (speed, load, and temperature) to be used for all engine applications.

When EGO sensors age they tend to switch slower because of a build-up of particulates on the EGO sensor's surface or because of other thermal effects such as sintering of the spinel layer which impede its ability to immediately sense the changing chemical composition of the exhaust gas. Because of this known behavior, the control system can modify the duration measurement to accommodate for the effects of sensor aging. If combinations not indicative of physical wall-wetting parameters are indicated by the temporal delay measurement, then the measurement (and subsequent measurements) may be adjusted to account for this behavior. Note that in the above discussion, injection of identification fuel charges were injected into the engine with no mention of individual cylinders. The described approach can also be used to identify the wall-wetting performance of individual cylinders as well.

In conclusion, the described approach actively compensates for changing wall-wetting parameters while an engine is operating in an end-user mission. This technique results in improved transient and cold engine performance, particularly as the engine ages, and while fuel composition changes. The described system uses an EGO sensor which keeps system complexity down and cost in control.

What is claimed is:

1. A method of adaptive transient fuel compensation for a cylinder in an engine comprising the steps of:

injecting an identifying fuel charge into the engine;

measuring a duration between when the identifying fuel charge is injected in the step of injecting, and when a binary-type exhaust gas oxygen sensor switches state; and adjusting a base fuel delivery to the engine, dependent on the duration measured in the step of measuring.

2. A method in accordance with claim 1 further comprising the steps of:

injecting a second identifying fuel charge into the engine;

measuring a second duration between when the second identifying fuel charge is injected in the step of injecting and when the binary-type exhaust gas oxygen sensor switches state; and wherein the step of adjusting the base fuel delivery comprises adjusting the base fuel delivery to the engine dependent on the measured duration and the measured second duration.

3. A method in accordance with claim 1 wherein the step of measuring a duration comprises counting a number of engine cycles between when the identifying fuel charge is injected, and when the binary-type exhaust gas oxygen sensor switches state.

4. A method in accordance with claim 1 wherein the step of injecting an identifying fuel charge comprises a step of injecting an identifying fuel charge into the cylinder having an impulse behavior.

5. A method in accordance with claim 4 wherein the impulse behavior is characterized by the identifying fuel charge having a duration of 1,440 engine degrees or less.

6. A method in accordance with claim 1 wherein the step of injecting an identifying fuel charge comprises a step of injecting an identifying fuel charge into the cylinder having a step behavior.

7. A method in accordance with claim 6 wherein the step behavior is characterized by the identifying fuel charge having a duration of 1,440 or more engine degrees.

8. A method in accordance with claim 2 wherein the step of injecting an identifying fuel charge comprises a step of injecting an identifying fuel charge using a step behavior.

9. A method in accordance with claim 8 wherein the step behavior is characterized by the identifying fuel charge having a duration extending between two and thirty engine revolutions.

10. A method in accordance with claim 1 wherein the step of measuring a duration comprises measuring a time difference between when the identifying fuel charge is injected in the step of injecting and when a binary-type exhaust gas oxygen sensor switches state.

11. A method in accordance with claim 1 wherein the step of measuring a duration comprises measuring a time difference between when the identifying fuel charge is injected in the step of injecting an identifying fuel charge, and when a binary-type exhaust gas oxygen sensor switches state.

12. A method of adaptive transient fuel compensation for a cylinder in a engine comprising the steps of:

generating a base fuel charge signal;

generating an identifying fuel charge signal;

combining the base fuel charge signal and the identifying fuel charge signal into a combined signal and injecting a combined fuel charge into the engine dependent on the combined signal;

measuring a temporal delay between when the combined fuel charge is injected, in the step of combining and injecting, and when a binary-type exhaust gas oxygen sensor switches state; and adjusting the base fuel charge signal, dependent on the temporal delay measured in the step of measuring.

13. A method in accordance with claim 12 further comprising the steps of:

generating a second identifying fuel charge signal;

combining the base fuel charge signal and the second identifying fuel charge signal into another combined signal and injecting another combined fuel charge into the engine dependent on the another combined signal;

measuring another temporal delay between when the another combined fuel charge is injected in the step of combining and injecting and when the binary-type exhaust gas oxygen sensor switches state; and wherein the step of adjusting the base fuel delivery comprises adjusting the base fuel delivery to the engine dependent on the measured temporal delay and the measured another temporal delay.

14. A method in accordance with claim 13 wherein a duration of the identifying fuel charge signal is less than 1,440 engine degrees, and a duration of the second identifying fuel charge signal is greater than 1,440 engine degrees.

15. A system of adaptive transient fuel compensation for an engine with a binary-type exhaust gas oxygen sensor coupled thereto, the system comprising:

means for injecting an identifying fuel charge into the engine;

means for measuring a duration between when the identifying fuel charge is injected, and when the binary-type exhaust gas oxygen sensor switches state; and means for adjusting a base fuel delivery to the engine, dependent on the duration measured by the means for measuring.

16. A system in accordance with claim 15 wherein the means for injecting injects a second identifying fuel charge into the engine;

wherein the means for measuring measures a second duration between when the second identifying fuel charge is injected in the step of injecting and when the binary-type exhaust gas oxygen sensor switches state; and wherein the means for adjusting the base fuel delivery adjusts the base fuel delivery to the engine dependent on the measured duration and the measured second duration.

17. A system of adaptive transient fuel compensation for an engine comprising:

a binary-type exhaust gas sensor coupled to an exhaust system of the engine for measuring an exhaust gas stream oxygen concentration, the sensor having an output providing a signal indicative thereof; and a gain adjustable feed-forward type compensator coupled to the output of the binary-type exhaust gas sensor, wherein a gain of the compensator is determined dependent on a temporal delay measured from when the compensator injects an identifying fuel charge into the engine, and when the output of the binary-type exhaust gas sensor indicates a change in state.

18. A method of adaptive transient fuel compensation for a cylinder in a engine comprising the steps of:

generating a base fuel charge signal;

generating an identifying fuel charge signal having a first duration;

combining the base fuel charge signal and the identifying fuel charge signal into a combined signal and injecting a combined fuel charge into the engine dependent on the combined signal;

measuring a temporal delay between when the combined fuel charge is injected, in the step of combining and injecting, and when a binary-type exhaust gas oxygen sensor switches state;

generating a second identifying fuel charge signal having a second duration longer than the first duration;

combining the base fuel charge signal and the second identifying fuel charge signal into another combined signal and injecting another combined fuel charge into the engine dependent on the another combined signal;

measuring another temporal delay between when the another combined fuel charge is injected in the step of combining and injecting and when the binary-type exhaust gas oxygen sensor switches state; and adjusting the base fuel delivery to the engine dependent on the measured temporal delay and the measured another temporal delay.

* * * * *